US008359808B2

(12) United States Patent
Stephens, Jr.

(10) Patent No.: US 8,359,808 B2
(45) Date of Patent: Jan. 29, 2013

(54) POLYSTYRENE WALL, SYSTEM, AND METHOD FOR USE IN AN INSULATED FOAM BUILDING

(75) Inventor: Roy Dean Stephens, Jr., Lockhart, TX (US)

(73) Assignee: Solid Green Developments, LLC, Austin, TX (US)

( * ) Notice: Subject to any disclaimer, the term of this patent is extended or adjusted under 35 U.S.C. 154(b) by 60 days.

(21) Appl. No.: 12/618,900

(22) Filed: Nov. 16, 2009

(65) Prior Publication Data

US 2011/0113707 A1 May 19, 2011

(51) Int. Cl.
*E04B 1/00* (2006.01)

(52) U.S. Cl. ..... 52/742.14; 52/220.2; 52/309.12; 52/432; 52/439

(58) Field of Classification Search ..... 52/424, 52/425, 426, 295, 309.11, 309.12, 309.17, 52/334, 427–432, 439, 606, 607, 745.13, 52/745.14

See application file for complete search history.

(56) References Cited

U.S. PATENT DOCUMENTS

| | | | | |
|---|---|---|---|---|
| 4,038,798 | A * | 8/1977 | Sachs | 52/309.7 |
| 4,823,534 | A | 4/1989 | Hebinck | |
| 4,924,641 | A | 5/1990 | Gibbar, Jr. | |
| 5,404,685 | A | 4/1995 | Collins | |
| 5,570,552 | A | 11/1996 | Nehring | |
| 5,697,189 | A | 12/1997 | Miller et al. | |
| 5,765,330 | A | 6/1998 | Richard | |
| 6,119,432 | A | 9/2000 | Niemann | |
| 6,401,413 | B1 | 6/2002 | Niemann | |
| 6,438,917 | B2 | 8/2002 | Kubica | |
| 7,198,159 | B2 | 4/2007 | Fischer | |

* cited by examiner

*Primary Examiner* — William Gilbert
(74) *Attorney, Agent, or Firm* — Hulsey, P.C.; William N. Hulsey, III; Loren T. Smith

(57) ABSTRACT

The present invention uses insulating concrete forms (ICF) in the construction of residential buildings. An entire wall panel is formed from polystyrene panels that may be cut by a hot wire machine. If necessary, hat channel shaped metal may be inserted into hat channel slots. Columns of polystyrene are removed so that concrete posts may be poured therein after the wall panel has been secured into place with rebar being located therein. Rebar and concrete also are formed along the top of the wall panel. Electrical and plumbing connection pathways are provided in the wall panel at the time of cutting with hot wire. Each wall panel is separately designed and cut by hot wire while still at the factory, but are all connected together to form an ICF residence. Openings are provided for doors and windows and are buck framed. Hat channels are inserted as necessary for strength and/or connection thereto.

22 Claims, 11 Drawing Sheets

POLYSTYRENE WALL, SYSTEM, AND METHOD FOR USE IN AN INSULATED FOAM BUILDING

BACKGROUND OF THE INVENTION

1. Field of the Invention

The present invention relates to a system and method of building a residential structure and, more particularly, to a residential structure having insulated concrete forms (hereinafter referred to as "ICF") that are used in forming the walls, which walls are attached to a concrete slab and to a roof.

2. Background of the Prior Art

As this country was being settled, early pioneers built homes from whatever was available. In the areas having a lot of trees, the homes were normally made out of logs. In other areas that were rocky, homes were made out of rock. As the plains area of the country was settled, homes were made out of sod. In arid regions, homes were made out of stucco or were even dug into the sides of hills or cliffs.

As time passed and this country was settled, the building of residential structures evolved to the use of wood frames. Sometimes precut stone or brick would also be used, but normally in conjunction with a wood framing. One of the problems with a wood framed house, with or without stone, is that it was expensive to heat in the winter and hard to cool in the summer. As the cost of energy has continued to rise, this has been a continuing concern for the homeowners and, hence, a concern for the home builders.

About forty to fifty years ago, a trend started to use foam for insulation purposes in residential buildings. Some times expanded foam was sprayed inside the walls or under the roofs of residential buildings to provide additional insulation. Later, panels were inserted to provide insulation. As the trend to use foam continued, insulating concrete forms (referred to as "ICF") started to be used in residential structures. Many different types of methods have evolved for building ICF residential buildings. However, fundamental problems still revolve around the methods being used to build ICF residential structures.

The first major problem is the prior systems require a lot of labor in the shaping, cutting or modifying the foam blocks for the particular structure. A second problem is that after cutting, shaping or modifying the foam structure, the foam structure loses much of its insulating value. Third, the insulating foam does not have the structural integrity so enough concrete must be used therewith to give the strength necessary for the structure.

An example of one of the prior ICF structures can be found in U.S. Pat. No. 6,401,413 issued to Niemann which shows an insulated concrete form wall building system. A pair of elongated expanded polystyrene side walls are located adjacent to each other with vertical ribs. Concrete is poured between the vertical ribs of the respective walls to form a composite polystyrene and concrete wall structure.

Another type of ICF walls is shown in U.S. Pat. No. 5,697,189 issued to Miller, et al and has fiber reinforced concrete faces, but expanded polystyrene in the middle thereof. Vertical structure concrete ribs are located between the insulating panels to provide structural support.

While the above were only two examples of patented systems that are already in existence, there are many others showing different types of ICF structures used in commercial and residential buildings. While each has its own advantages and pit falls, the major problem is the expense involved in building the structures. If the expense is held down, normally the buildings do not have the structural integrity.

SUMMARY OF THE INVENTION

It is an object of the present invention to provide an ICF residential structure.

It is another object of the present invention to provide a method of building an ICF residential structure using precut, ready to use, expanded foam panels.

It is yet another object of the present invention to use precut polystyrene panels to form walls on a foundation of a residential structure, which wall columns may then be poured with concrete to give structure strength.

It is yet another object of the present invention to design each panel of polystyrene that may be cut in the factory and delivered to the job site for construction into the building of an ICF residential structure with a minimum amount of labor being required at the job site.

It is still another object of the present invention to provide reinforcement in the concrete columns of an ICF residential structure in the form of rebar or other suitable reinforcing material.

It is yet another object of the present invention to provide pathways in the ICF structure through which electrical wiring and plumbing lines may be installed to the inside or outside of a residential structure.

In the present invention, the slab for a residential structure is poured to the desired specifications. Each wall panel is designed and precut at the factory to the desired specification. When the precut panels are delivered to the job site, any undesired foam is removed and any metal strengthening such as hat channels may be inserted.

The precut panels are then arranged vertically on the foundation and securely held in position by a wall alignment system. Once rebar is in place, concrete is poured in the appropriate columns forming the wall. A wood buck is placed around the windows and doors. For the door jams, rebar is driven into the adjacent concrete column while the concrete is still wet to hold and support the door jam when the concrete dries.

After the concrete has hardened, the wall alignment system is removed, windows and doors bucked and a 2×12 board is attached to J screws extending out of the top of the concrete on each of the walls.

Depending upon the inside finish out plan for the residence, suitable connections can be provided through hat channels to support the inside finish. Typically, thy wall would be used on the inside of the house. The dry wall would be secured in position by screws extending into the hat channels.

On the outside of the residential structure, any desired type of outside finish can be used. If stucco is used, it can be applied directly to the foam. If a brick facade or some other type of facade is desired, it may be necessary to have external hat channels to which the facade may be attached. The same would be true for fiber cement siding.

If the external structure is brick, anchors for the brick would still be provided by attachments to the hat channels, but a ledge to support the brick would be necessary on the foundation.

DESCRIPTION OF THE PREFERRED EMBODIMENT

Figure 1:
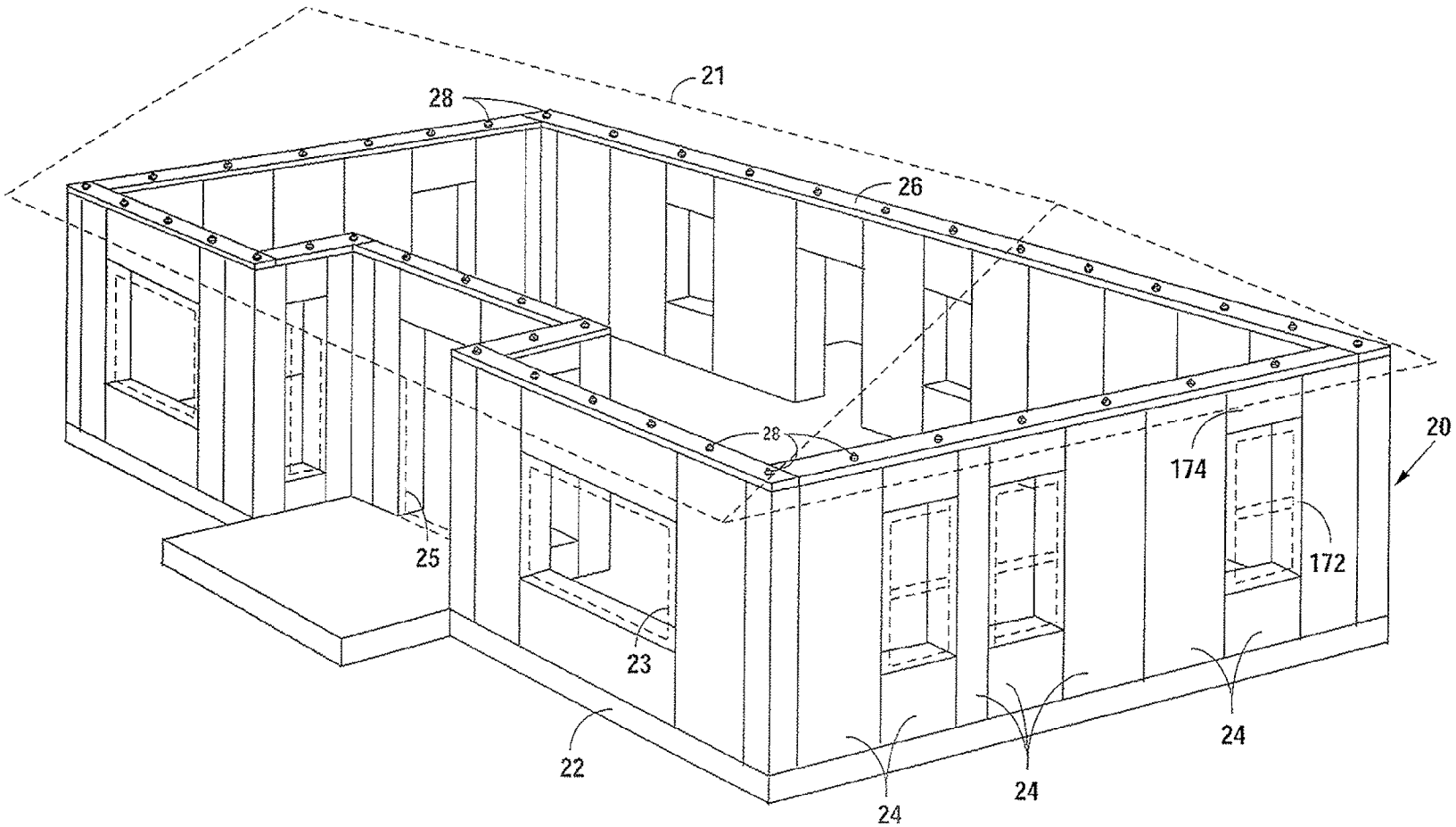
FIG. 1 is a pictorial perspective of the walls of a residential structure embodying the present invention, which walls are located on a foundation of the residence with the roof, windows and doors being shown in broken lines.

Referring now to FIG. 1 of the drawings, a frame 20 for a residential structure is located on a foundation 22 and has a roof structure 21 attached thereto. The foundation 22 is typically made of reinforced concrete. The frame 20 has a series of wall panels making up the frame 20, each of the wall panels 24 being separately designed for the particular residence. The frame 20 has windows 23 and doors 25 therein as would be found in most residences. The top of the frame 20 is capped off by a 2×12 board 26 that is held in position by J bolts 28. The frame 20 and the panels 24 making up the frame will be discussed in further detail hereinbelow.

Foam, whether polystyrene or some other type expanded foam, is typically delivered in blocks that are 8 ft.×8 ft.×16 ft. These blocks are cut into pieces with the largest piece being 4 ft.×1 ft.×8 ft. Since the 8 foot length represents the ceiling height, sometime that may vary and may be up to 9 ft in height. Typically if a 9 ft. ceiling is being provided for in the structure, the original block may be 9×8×16, or the original 8×8×16 ft. block has to be cut in a different manner.

Regardless of the height or length, each panel is approximately one foot thick. That thickness represents the thickness of the wall for the residence being built. It has also been found that 1½ lb. density polystyrene is ideal for use in the present invention.

Figure 1A:
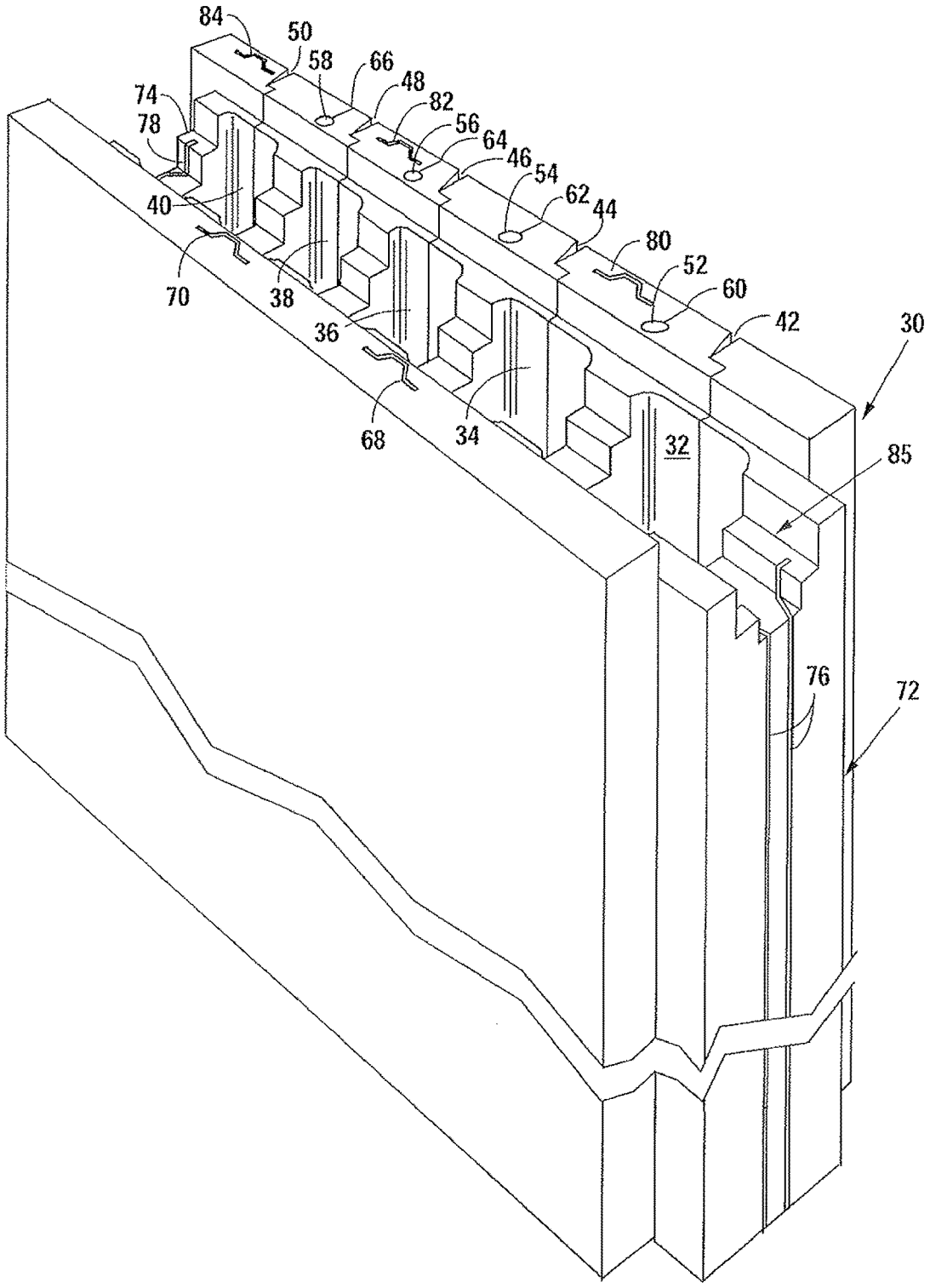
FIG. 1A is an inside perspective view of a typical expanded foam panel that may be used in the present invention.
Figure 1B:
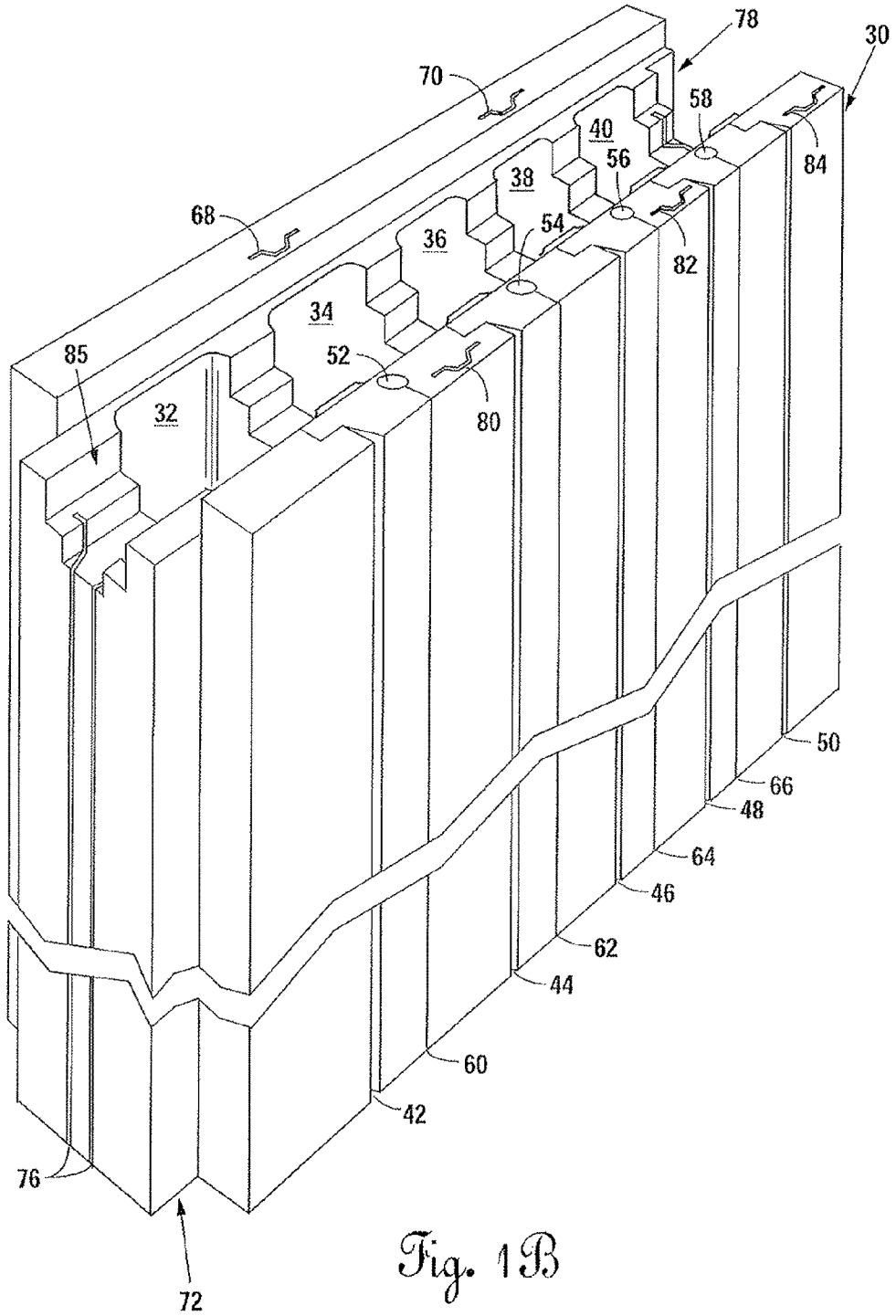
FIG. 1B is an outside prospective view from FIG. 1A.

Referring now to FIGS. 1A and 1B in combination, a five column panel 30 is shown. To form the five column panel 30, a 4×1×8 ft. block is fed through a hot wire machine (not shown) at the factory. The hot wire machine (not shown) simultaneously cuts out the columns 32, 34, 36, 38 and 40 through hot wire slots 42, 44, 46, 48 and 50, respectively. During the same pass in the hot wire machine, electrical and plumbing passage ways 52, 54, 56 and 58 are cut through hot wire slots 60, 62, 64 and 66, respectively.

Simultaneously with this first pass through the hot wire machine, hat channel slots 68 and 70 are cut. Hat channel slots 68 and 70 are cut by the same wires that cuts out columns 34 and 38 respectively. At this point at the factory, none of the foam form in columns 32, 34, 36, 38 and 40, nor the circular foam portions in the electrical passage ways 52, 54, 56 and 58 are removed.

Simultaneously with the cutting of the columns 32, 34, 36, 38 and 40, electrical and plumbing passage ways 52, 54, 56 and 58, and the hat channel slots 68 and 70, the male end 72 and the female end 74 of the five column panel 30 are cut. With the same pass, hat channels 76 and 78 are cut into male end 72 and the female end 74, respectively.

Depending upon the interior finish that is desired in the residence, the five column panel 30 may have to be run through a hot wire machine again to cut additional hat channel slots 80, 82 and 84 on the inside of the five column panel 30.

Each of the columns 32, 34, 36, 38 and 40 are approximately six inches square, but with rounded corners. The foam between the columns is approximately 2 inches thick.

After passing through the hot wire machine as described hereinabove, the five column panel 30 is again run through the hot wire machine after being rotated 90 degrees. During this next pass through the hot wire machine, the top end 85 of the five column panel 30 is cut out as shown in FIGS. 1A and 1B. The purpose of this shape will be explained in more detail subsequently.

Figure 2:
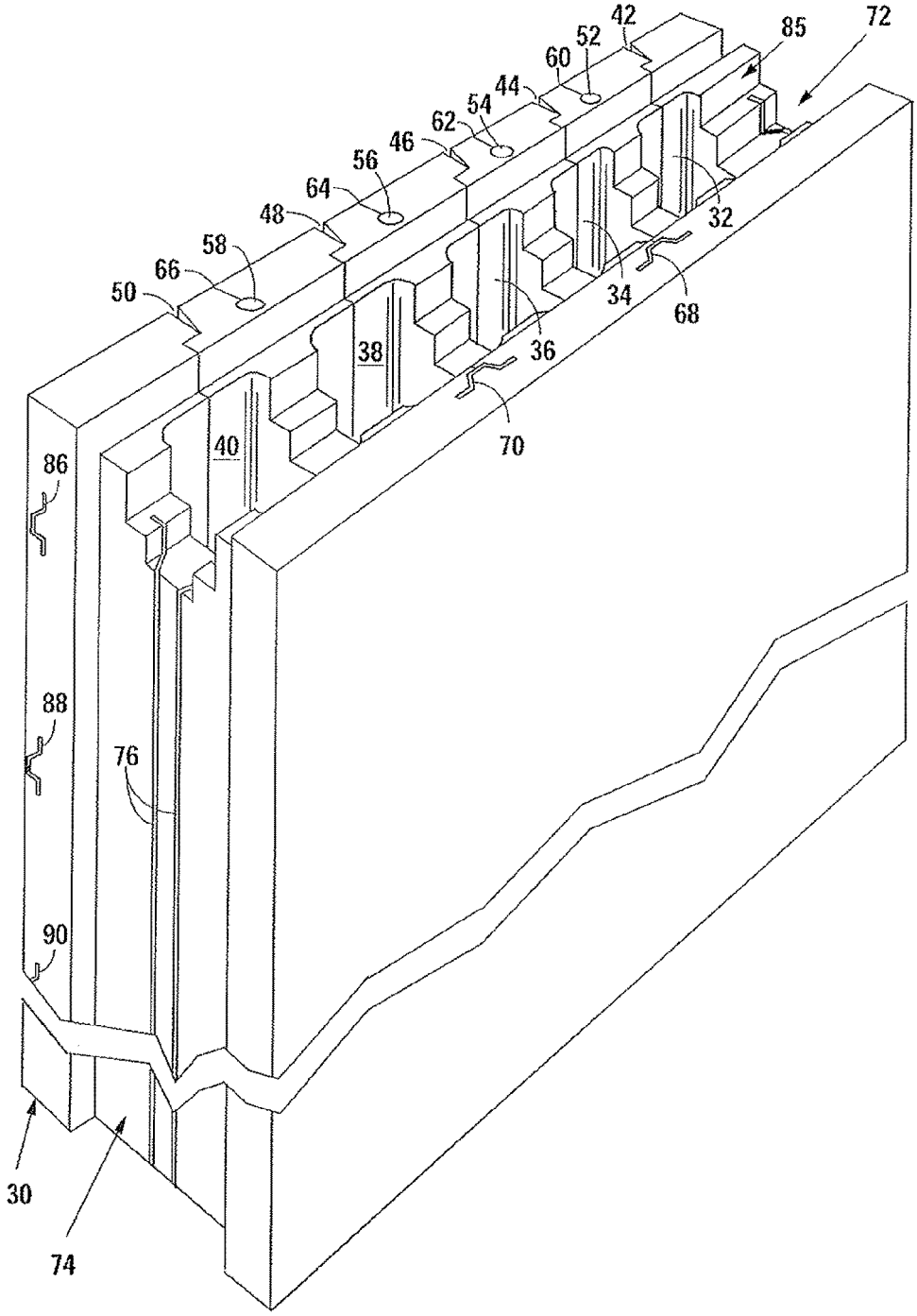
FIG. 2 is an opposing perspective view from FIG. 1A, but showing the female end of an expanded foam panel and with inside hat channel slots being horizontal.

Referring to FIG. 2, an opposing perspective view from FIG. 1A is shown so the particular shape of the female end 74 of the five column panel 30 can be seen. However, in the perspective view as shown in FIG. 2, the hat channel slots 80, 82 and 84 that were located vertically in FIGS. 1A and 1B, are cut horizontally in FIG. 2 and labeled as 86, 88 and 90.

Figure 3:
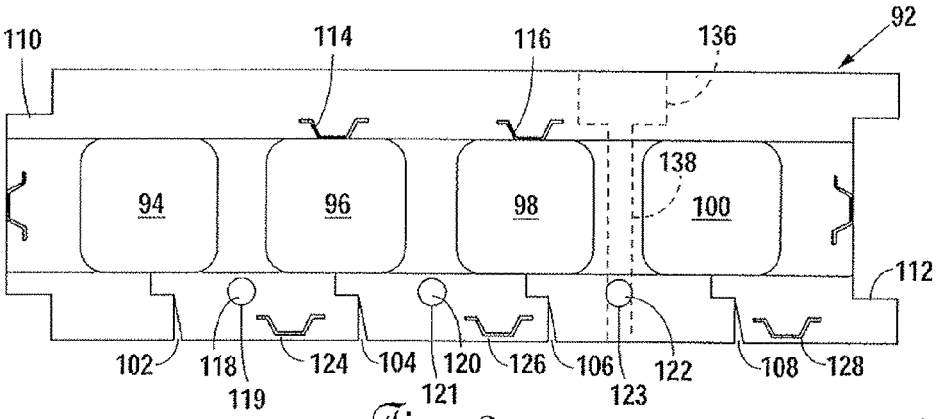
FIG. 3 is a top view of a four column panel also illustrating an external electrical opening and cross passage.
Figure 4:
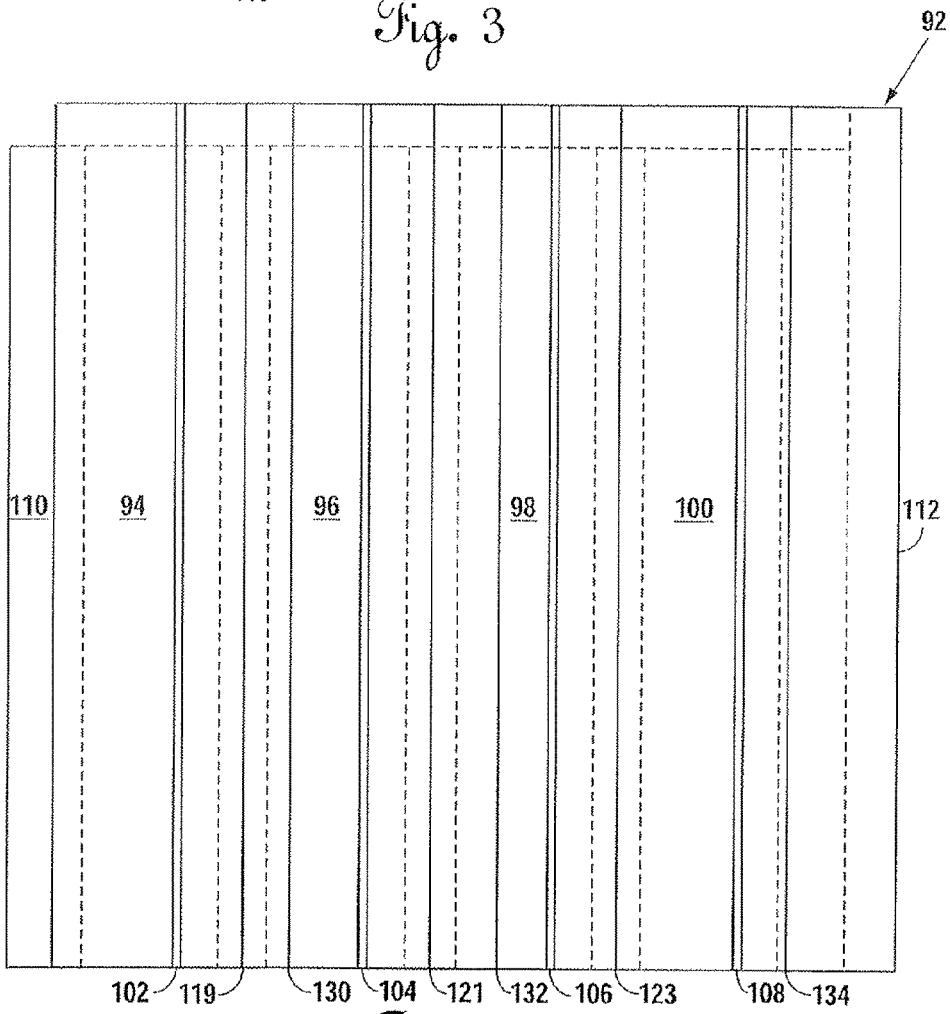
FIG. 4 is a front view of FIG. 3.

Referring now to FIGS. 3 and 4 in combination, a four column panel 92 is shown. The four column panel 92 has columns 94, 96, 98 and 100, which are cut through hot wire slots 102, 104, 106 and 108, respectively. Simultaneous with the same pass through the hot wire machine (not shown), the male end 110 and the female end 112 are also cut. Likewise, during the same pass through the hot wire machine, hat channel slots 114 and 116 are cut at the back of columns 96 and 98. Electrical and plumbing passage ways 118, 120, and 122 are also cut through hot wire slots 119, 121 and 123, respectively.

If vertical inside hat channel slots are to be used, inside hat channel slots 124, 126 and 128 are cut through hot wire slots 130, 132 and 134.

The fundamental difference between the four column panel 92 as shown in FIGS. 3 and 4 and the five column panel 30 as shown in FIGS. 1A and 1B is the horizontal length. Obviously, the horizontal length may have to vary depending upon where the panel is to be used in the residential structure. Also, illustrated in FIG. 3 is the connection to an outside receptacle which goes into opening 136 connected by a cross passage 138 to electrical passage way 122. By insertion of suitable electrical wire (not shown) through electrical passage way 122, cross passage 138 to opening 136, an electrical receptacle can be provided with power on the outside of the residence.

Figure 5C:
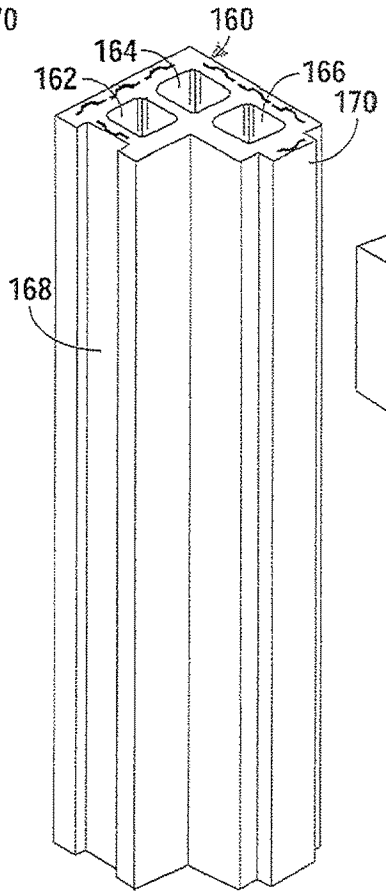
FIG. 5C is an opposing perspective view from FIG. 5B.
Figure 5B:
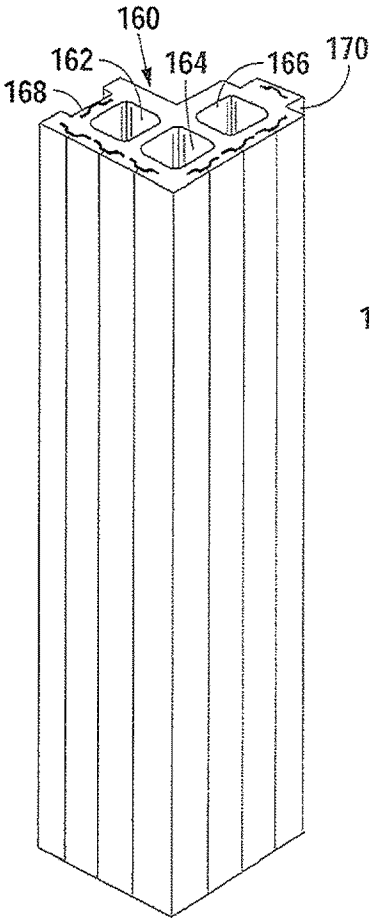
FIG. 5B is a perspective view of a corner block having three columns.
Figure 5A:
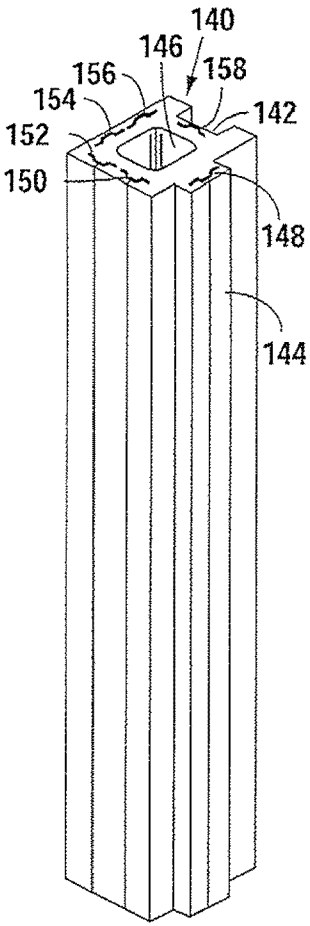
FIG. 5A is a perspective view of a corner block having a single column.

Referring now to FIG. 5A, a vertical corner block 140 is shown, which vertical corner block 140 is again made out of expanded foam and is typically 8 ft. in length. When passing the vertical corner block through the hot wire machine, the female end 142 and the male end 144 are formed therein. Simultaneously, the column 146 is cut simultaneous with hat channel slots 148, 150, 152, 154, 156 and 158. The additional hat channel slots are for strength and for connection to the corner of the residential structure. The vertical corner block 140 as shown in FIG. 5A only has one column, namely, column 146.

FIGS. 5B and 5C shows opposing perspective views for three column vertical corner blocks 160. While it is preferred to use a three column vertical corner block 160, sometimes it may only be possible to use a single column vertical corner block as shown in FIG. 5A. The three column vertical corner block 160 has columns 162, 164 and 166. However, in FIG. 5C, the three column vertical corner block 160 has been flipped to the opposite end from the view as shown in 5B. The female end 168 and the male end 170 are clearly shown in the three column vertical corner block 160. The use of the hot wire machine to cut the columns 162, 164 and 166, the female end 168, the male end 170 and the various hat channel slots in the three column vertical corner block 160 are the same as previously described hereinabove for prior figures.

Referring to the frame 20 of the residence being constructed as shown in FIG. 1, window openings 172 are located within the frame 120. Above the window 172 as shown in FIG. 1 is located an upper window panel 174.

Figure 6:
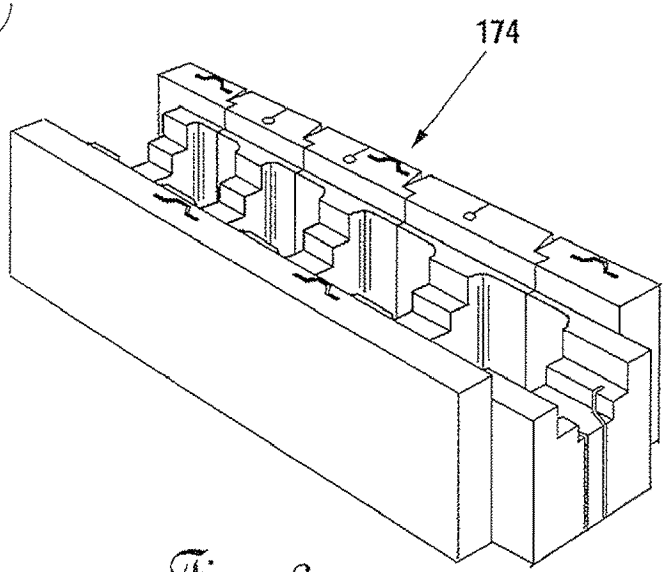
FIG. 6 is a perspective view of a panel that may be used above a window or door.

Referring to FIG. 6, a perspective view as shown of upper window panel 174. The upper window panel 174 is basically the same as the four column panel 92 except it is shorter. That is so the upper window panel 174 can fit above the window opening 172. Other similar upper window panels will be used throughout the frame 20 for other window openings.

Figure 7:
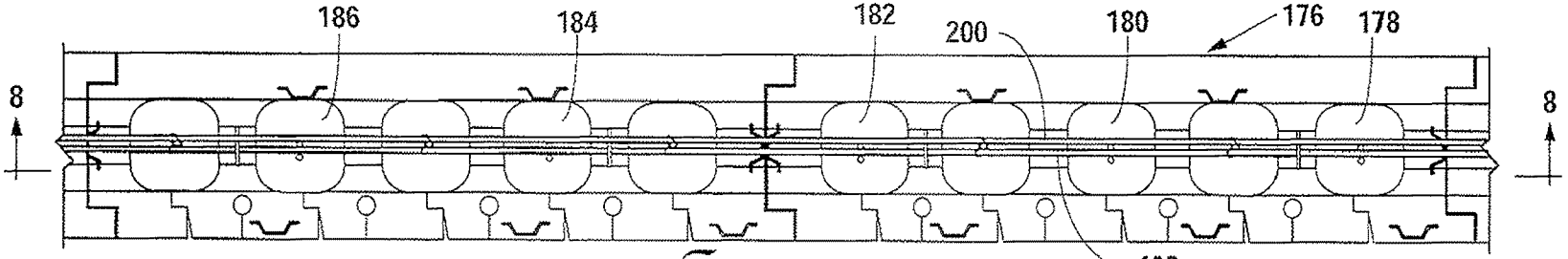
FIG. 7 is a top view of a section of a wall utilizing the present invention.
Figure 8:
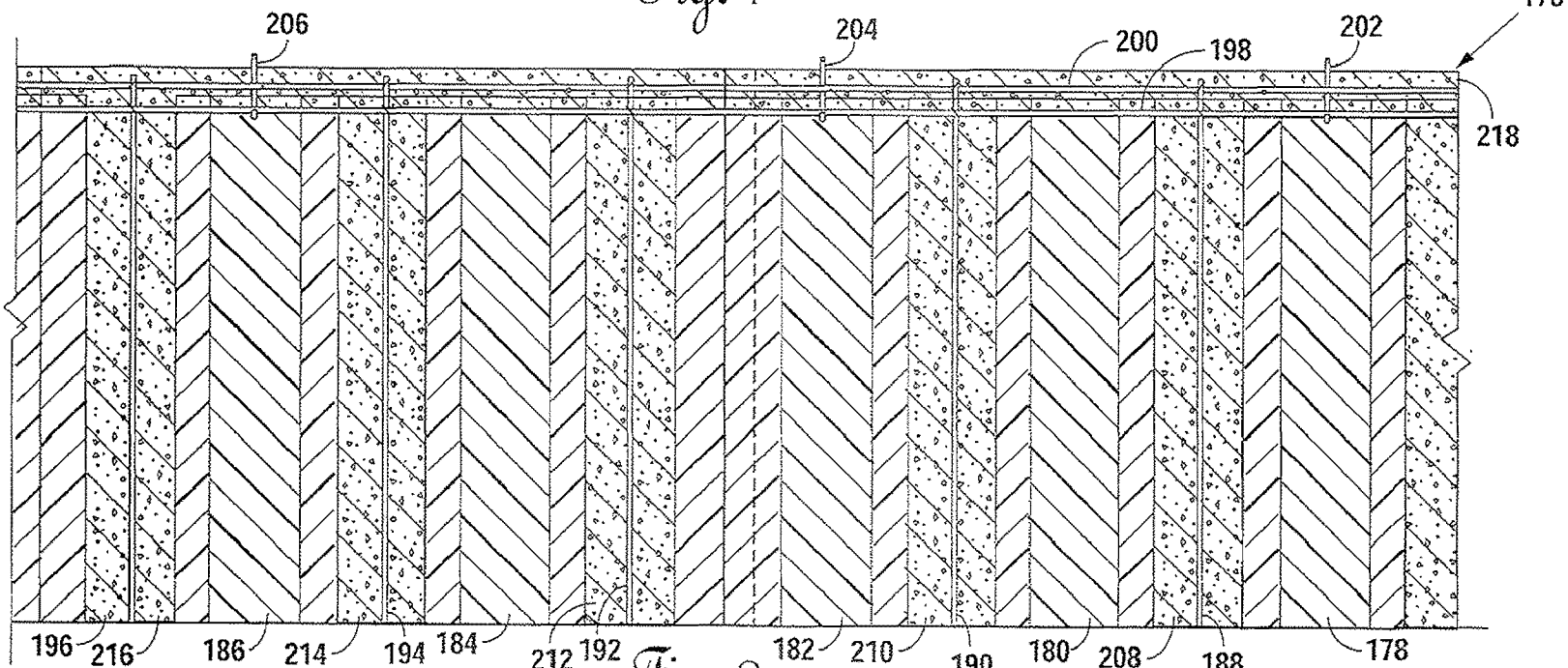
FIG. 8 is a cross-sectional view of FIG. 7 taken along section lines 8-8.

Referring now to FIGS. 7 and 8 in combination, a typical wall section for the frame 20 of a residence is shown and indicated with reference numeral 176. The wall section 176 is in place on a suitable foundation such as foundation 22. Foam columns 178, 180, 182, 184 and 186 remain within the wall section 176. It has been found for single story residences, only every other foam column needs to be removed and filled with concrete. Therefore, every other foam column 178, 180, 182, 184 and 186 have not been removed in the wall section 176. If the structure being built was a two story structure and this was the lower level, then all of the foam columns would be removed and filled with concrete.

In the other columns not containing foam as shown in FIGS. 7 and 8, rebar 188, 190, 192, 194 and 196 extends from the foundation 122 (see FIG. 1) up to the top end cut 85 (see FIGS. 1A and 1B) and rebar 188, 190, 192, 194 and 196 are tied to cross rebar 198 and 200. On approximate 4 ft. centers J bolts 202, 204 and 206 are also tied to cross rebar 198 and 200. The J bolts 202, 204 and 206 extend above the top of wall section 176 by approximately 3 inches.

When concrete is poured into the wall section 176 as will be subsequently described, concrete columns 208, 210, 212, 214 and 216 are formed around rebar 188, 190, 192, 194 and 196, respectively to form concrete reinforced columns. Across the top a concrete plate 218 is poured and formed in the top end cut 85 (see FIGS. 1A and 1B).

Figure 9:
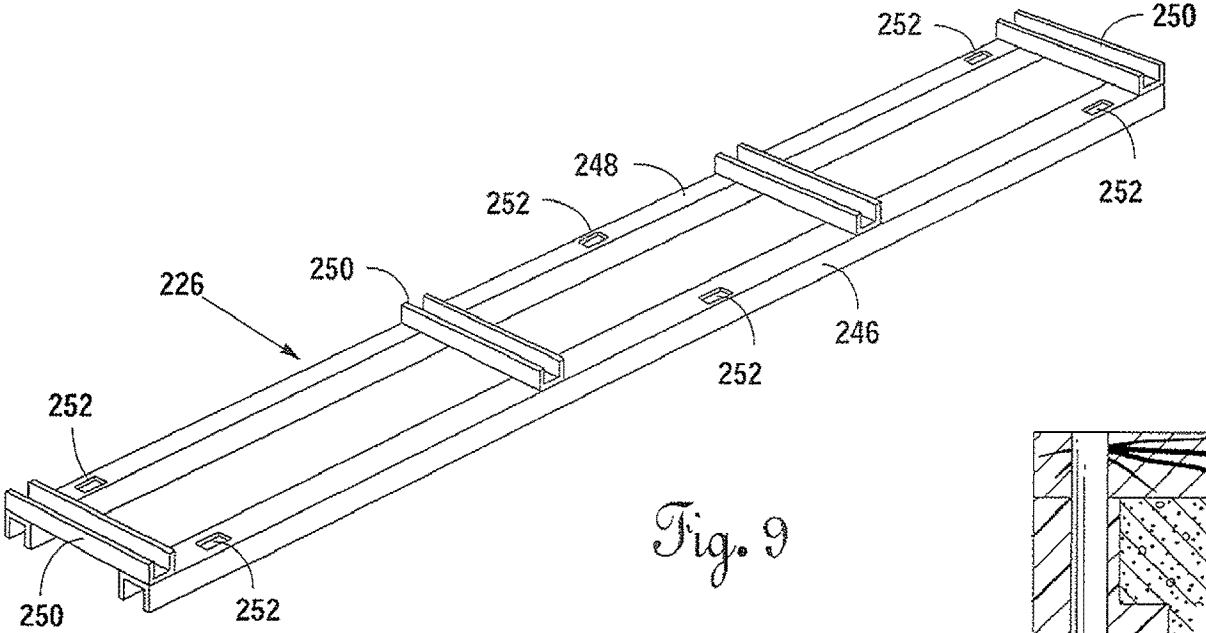
FIG. 9 is a perspective view of a wall alignment frame.
Figure 10:
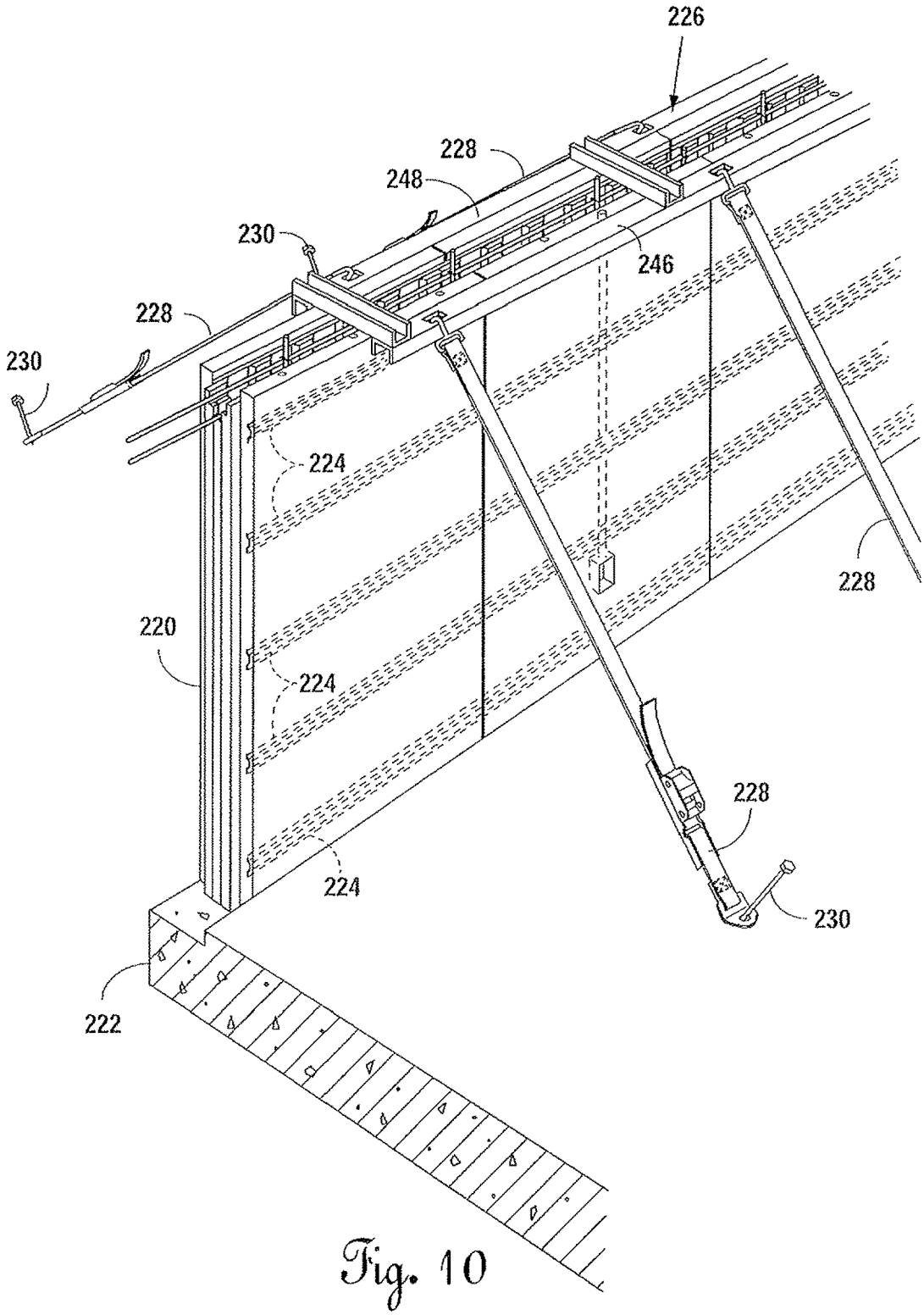
FIG. 10 is a perspective view of one section of the wall being held in position by the wall alignment frame prior to pouring of the concrete.

Referring now to FIGS. 9 and 10 in combination, a wall section 220 is being constructed on foundation 222 using the present invention. In the wall section 220, the inside hat channels 224 are arranged horizontally based on the preference of this builder. The hat channels used to support inside finishing materials or outside finishing materials can be either vertical or horizontal depending upon the preference of the builder or end user.

To hold the wall section 220 vertical while the concrete is being poured, a wall alignment frame 226 (see FIG. 9) is located on top of wall section 220. Straps 228 are connected between the wall alignment frame 226 and anchors 230 with the straps 228 being adjusted to make sure the wall section 220 is absolutely vertical. Thereafter, the concrete is poured in the top end cut 85 (see FIGS. 1A and 1B) to form a wall section similar to the one in FIGS. 7 and 8.

Figure 11:
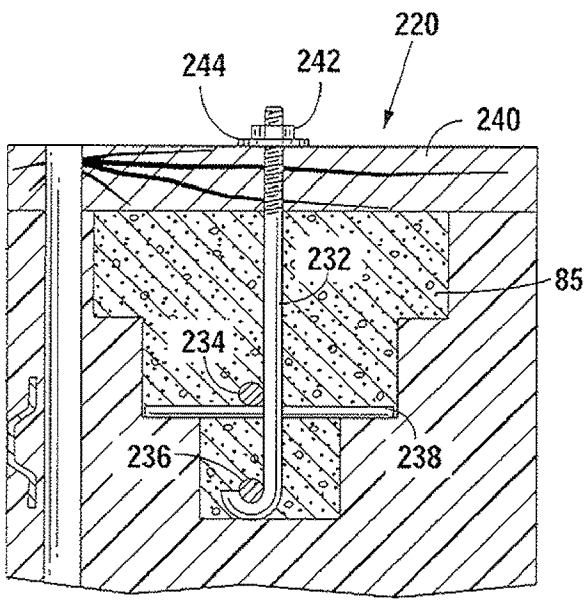
FIG. 11 is a cross-sectional view of an upper portion of the wall after pouring and attachment of a 2×12 board thereto.

Referring to FIG. 11, a top part of the wall section 220 is cross sectioned at a J bolt after the wall section 220 has been completed. The J bolt 232 as shown in FIG. 11 is wired to cross rebar 234 and 236. The bottom of the J bolt 232 receives the cross rebar 236 therein in the bottom of the J. The upper cross rebar 234 is held in position and wired to the J bolt 232 and a cross bar 238. The cross bar 238 holds the upper cross rebar 234 at the ideal height within the top end cut 85. When the wall section 220 is completed as shown in FIG. 11, a 2×12 board 240 is bolted into position and held there by nut 242 and washer 244.

Referring now to the wall alignment frame 226 as shown in FIG. 9, the horizontal channels 246 and 248 are spaced apart by 12 inches so that a wall section will fit exactly therein so that it can be held in position. Cross channels 250 hold the horizontal panels 246 and 248 in position. Slots 252 provide a place for the straps 228 to connect to the wall alignment frame 226 as shown in FIG. 10.

Figure 13:
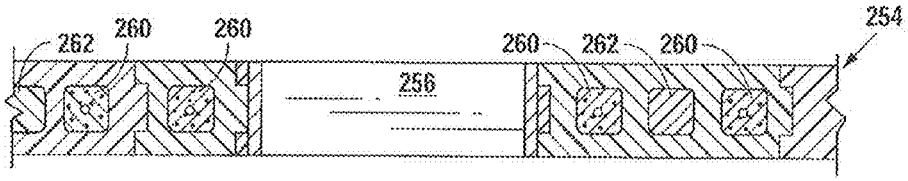
FIG. 13 is a sectional view of FIG. 12 along sectional lines 13-13.
Figure 12:
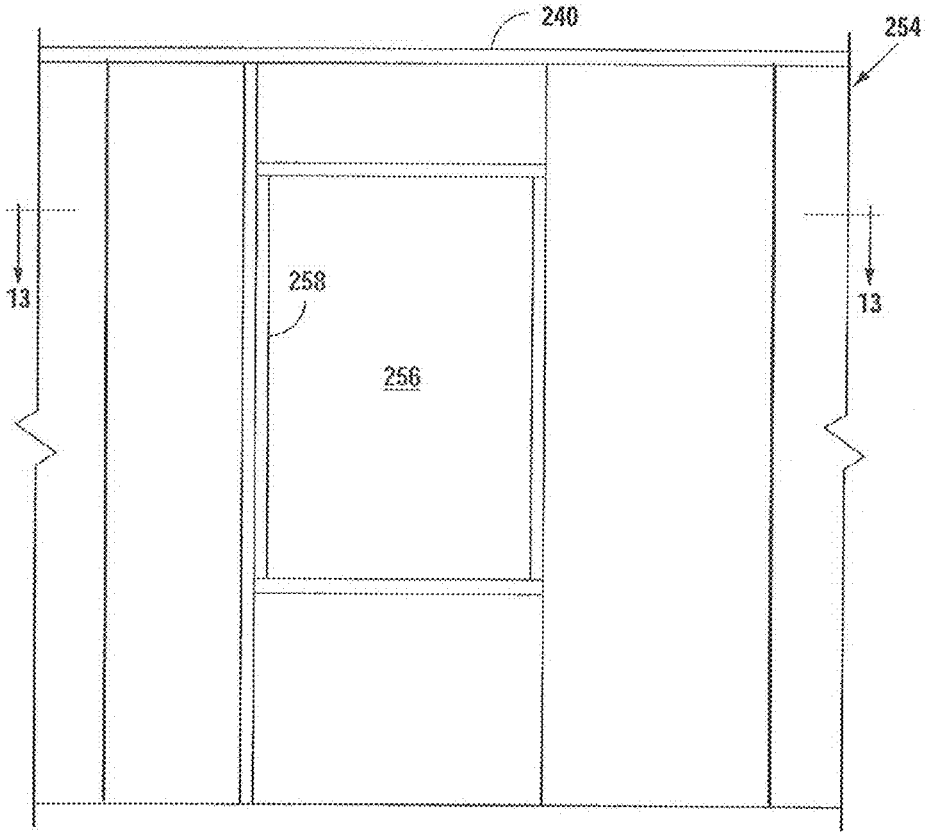
FIG. 12 is an elevated view of a section of the wall using the present invention having a window therein.

Referring to FIGS. 12 and 13 in combination, a wall section 254 is shown that includes a window 256. The wall section 254 has the 2×12 board 240 across the top thereof. The window opening 256 has a window buck 258 therearound, which window buck 258 is normally made of wood. As can be seen in FIG. 13, only some of the columns are concrete columns 260. The other columns are foam columns 262.

Figure 14:
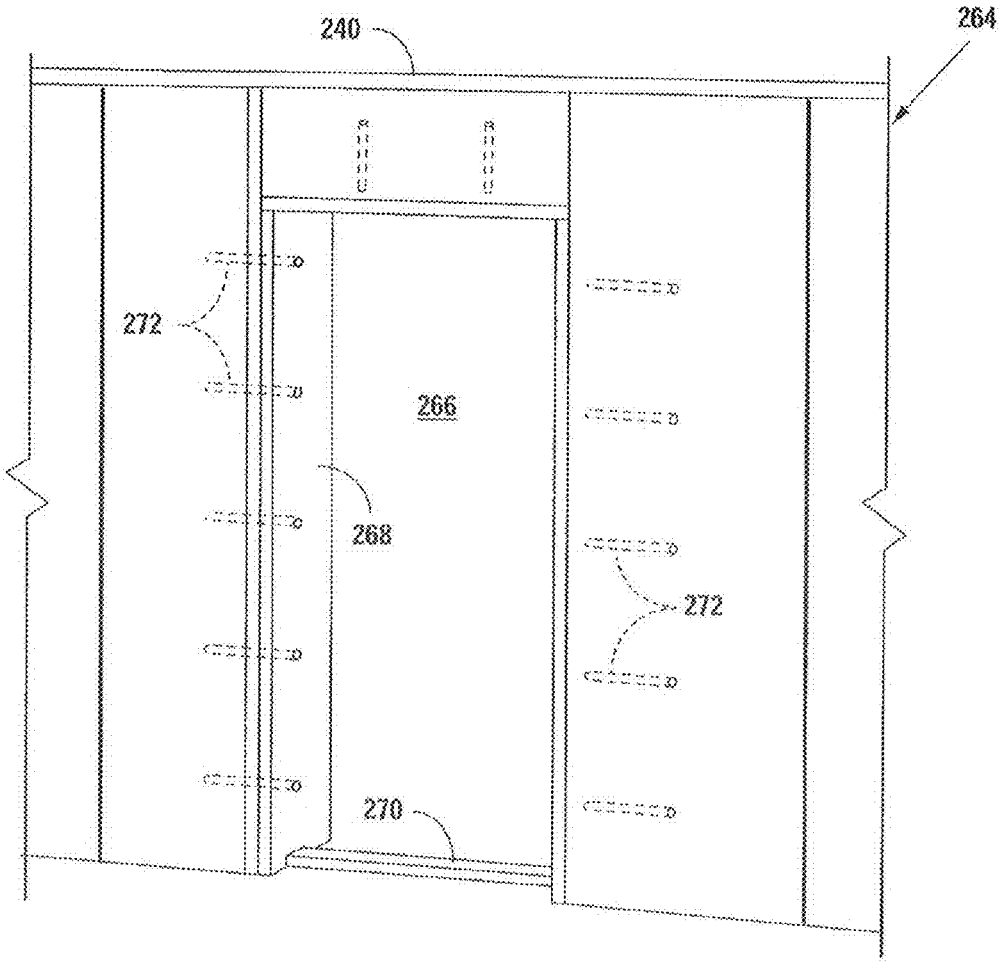
FIG. 14 is a front partial perspective view of a section of a wall utilizing the present invention in which a door is located.

Referring now to FIG. 14, a wall section 264 is shown that has a doorway 266 therein. The wall section 264 has the 2×12 board 240 at the top thereof. The doorway 266 has a door buck 268 therearound along with a door jam 270 at the bottom thereof. When the wall section 264 is poured and while the concrete therein is still wet, door rebar 272 is driven into the wet concrete and used to hold the door buck 268 in position. Thereafter, when the concrete hardens, the door rebar 272 will securely hold the door buck 268.

Once the frame 20 has been completed on the foundation 22 as shown in FIG. 1, a roof 21 may be constructed in the normal matter. Wiring is provided through the electrical passage ways and may be inserted prior to the building of the roof 21, or afterwards if that is a preference of the builder. To save crawling in attic space, it may be preferred to insert the wiring prior to building the roof 21.

The external part of the frame 20 can be completed in any manner desired by the builder such as stucco, brick facade, hardy board or some other type of external structure. If stucco is used, external hat channels are not required. However, if other type of external finish is used that requires attachment to the frame 20, external hat channels will be required. Internally, the frame 20 can be finished in any manner desired. Assuming sheet rock is the preferred internal finish, the sheet rock can be connected through hat channels to the frame 20 once the roof 21 has been installed and the structure has a dry interior.

By building a residence using the present invention, it will cost approximately the same as a conventionally built house. Under conventionally built houses, approximately fifty percent of the cost is spent in materials and fifty percent is spent in labor. For a residence built according to the present invention, approximately 75% of the cost will be in materials and 25% will be in labor. Overall, the cost of building a house by either conventional methods or by the present invention will be approximately the same. However, once a house is built by the present invention, the amount of energy required to heat or cool the house will be a small fraction of what would be required if the house had been built by conventional means.

I claim:

1. A method of manufacturing an insulated form building, the method comprising the following steps:

creating at least one passageway in a wall panel, said wall panel having an outer surface, said passageway operable to receive cabling, conduit, ducting, and/or pipes when the polystyrene is removed from said passageway;

creating at least one column in said wall panel, said column operable to receive structural fill material when the polystyrene is removed from said column;

cutting from said outer surface into said wall panel at least until said cut path breaches said column opening, wherein said cut deviates from a straight line between said outer surface and said column opening to form a lip, said lip having abutting regions, said abutting regions compressing together when said structural fill material is introduced to said column opening;

creating at least one support/alignment opening into said wall panel, said support/alignment opening operable to receive a material for supporting wall finish and/or aligning said panels;

creating a male end in one end of said wall panel; and creating a female end in another end of said wall panel, said other end being substantially opposite from said male end and wherein said female end is operable to receive the male end of another panel and thereby align the panels.

2. The method of claim 1, wherein said creating steps are performed at a location other than the final installation location.

3. The method of claim 1, with the additional steps of:

creating a window void out of said wall panel, wherein said window void is operable to receive a window when the polystyrene is removed from said window void; and/or creating a door void out of said wall panel, wherein said door void is operable to receive a door when the polystyrene is removed from said door void.

4. The method of claim 1, with the additional step of creating a top opening into a top of said wall panel, said top opening operable to receive structural fill material.

5. The method of claim 4, with the additional steps of:

inserting said male end of a first wall panel into the female end of a second wall panel;

removing the polystyrene from at least one column and thereby creating a column void;

inserting at least one column reinforcing member into said column void;

inserting at least one top reinforcing member into said top opening, said top reinforcing member coupled to said column reinforcing member;

inserting structural fill material into said top opening and said column void substantially simultaneously.

6. The method of claim 4, with the additional steps of:

removing the polystyrene from said support/alignment opening to create a support/alignment void; and inserting material for supporting wall finish and/or aligning said panels into said support/alignment void.

7. An insulated form building, the building comprising:

at least one wall panel having an outer surface, said panel made substantially of polystyrene and comprising:

a passageway opening, said passageway opening operable to receive cabling, conduit, ducting, and/or pipes when the polystyrene is removed from said passageway opening;

a support/alignment opening, said support/alignment opening operable to receive a material for supporting wall finish and/or for aligning multiple of said panels;

a column opening, said column opening operable to receive structural fill material when the polystyrene is removed from said column opening;

a cut, said cut beginning from said outer surface and traveling into said wall panel at least until said cut breaches said column opening, wherein said cut deviates from a straight line between said outer surface and said column opening to form a lip, said lip having abutting regions, said abutting regions compressing together when said structural fill material is introduced to said column opening;

a male end; and a female end, wherein said female end is operable to receive the male end of another panel and thereby align the panels.

8. The building of claim 7, wherein said male end is a tongue and said female end is a groove.

9. The building of claim 7, wherein said panel additionally comprises:

a window opening, wherein said window opening is operable to receive a window when the polystyrene is removed from said window opening; and/or a door opening, wherein said door opening is operable to receive a door when the polystyrene is removed from said door opening.

10. The building of claim 9, wherein said panel additionally comprises:

a window buck, said window buck coupled to the sides of said window opening after said polystyrene is removed from said window opening; and/or a door buck, said door buck coupled to the sides of said door opening after said polystyrene is removed from said door opening.

11. The building of claim 7, comprising at least two panels, wherein said male end of one panel is inserted into said female end of another panel to form a wall, said panels additionally comprising a top opening, said top opening operable to receive structural fill material.

12. The building of claim 11, wherein the polystyrene is removed from at least one of said column openings thereby creating a column void, wherein said column void is filled with structural fill material and at least one column reinforcing member.

13. The building of claim 12, wherein said top opening is substantially filled with structural fill material and at least one top reinforcing member, said top reinforcing member coupled to said column reinforcing member and wherein said column void and said top opening are filled with structural fill material substantially simultaneously.

14. The building of claim 13, wherein said column void and/or said top opening are lined with a substantially waterproof lining prior to filling with said structural fill material.

15. The building of claim 13, wherein a top plate is coupled to said structural fill material in said top opening immediately after said fill is inserted into said top opening.

16. The building of claim 7, wherein said panels include a full size panel and a top panel, wherein the height of said top panel is less than the height of said full size panel and said top panel is aligned with a top of said full size panel such that a void remains below a bottom of said top panel.

17. The building of claim 16, additionally comprising a bottom panel, wherein the combined height of said bottom panel and said top panel are less than the height of said full size panel and said bottom panel is aligned with a bottom of said full size panel such that said void is between a top of said bottom panel and said bottom of said top panel, said void operable to receive a window.

18. The building of claim 7, wherein said structural fill material is at least one of:

concrete;
sand;
compacted earth;
plastic;
wood; and
composite.

19. An insulated form building, the building comprising:

at least two polystyrene wall panels, said panels comprising:
an outer surface;
an inner surface;
a male end;
a female end;
a top;
a bottom; and
a series of openings, said openings between said outer surface and said inner surface, wherein said openings are made at a geographical location other than the final installation location and comprising:
a passageway opening, said passageway opening operable to receive cabling, conduit, ducting, and/or pipes when the polystyrene is removed from said passageway opening;
a support/alignment opening, said support/alignment opening operable to receive a material for supporting wall finish and/or aligning said panels when the polystyrene is removed from said support/alignment opening;
a column opening, said column opening operable to receive structural fill material when the polystyrene is removed from said column opening;
a cut, said cut beginning from said outer surface and traveling into said wall panel at least until said cut breaches said column opening, wherein said cut deviates from a straight line between said outer surface and said column opening to form a lip, said lip having abutting regions, said abutting regions compressing together when said structural fill material is introduced to said column opening; and
a top opening, said top opening operable to receive structural fill material;
wherein said female end of one panel receives the male end of another panel and thereby aligns the panels.

20. The building of claim 19, wherein:

the polystyrene is removed from at least one of said passageway openings leaving a passageway void and cabling, conduit, ducting, and/or pipes are inserted into said passageway void;
the polystyrene is removed from at least one of said support/alignment openings leaving a support/alignment opening void and material for supporting wall finish and/or aligning said panels is inserted into said support/alignment opening void;
the polystyrene is removed from at least one of said column openings leaving a column void and at least one column reinforcing member is inserted into said column void; and
at least one top reinforcing member is inserted into said top opening, said top reinforcing member coupled to said column reinforcing member and structural fill material is inserted into said top opening and said column void substantially simultaneously.

21. The building of claim 20, wherein said material for supporting wall finish and/or aligning said panels is a hat channel.

22. The building of claim 10, wherein said polystyrene is substantially one pound to two pound density foam.

* * * * *